United States Patent [19]

Pohl et al.

[11] 3,974,602

[45] Aug. 17, 1976

[54] MONO-COQUE BUILDING STRUCTURE AND METHODS

[76] Inventors: Robert Pohl, Rte. 2, Hallettsville, Tex. 77964; Bascom Nelson, Box 24, Mineral, Tex. 78125

[22] Filed: Feb. 10, 1975

[21] Appl. No.: 548,542

[52] U.S. Cl. ..... 52/93; 52/143

[51] Int. Cl.[2] ..... E04H 1/02; E04B 7/02

[58] Field of Search ..... 52/90, 93, 143, 281, 52/86, 643, 639, 45

[56] References Cited

UNITED STATES PATENTS

| | | | |
|---|---|---|---|
| 1,267,084 | 5/1918 | Knox | 52/644 X |
| 3,019,861 | 2/1962 | Rasch | 52/93 X |
| 3,279,132 | 10/1966 | Slayter | 52/643 |
| 3,309,120 | 3/1967 | Wada | 52/93 |

FOREIGN PATENTS OR APPLICATIONS

| | | | |
|---|---|---|---|
| 913,111 | 8/1946 | France | 52/90 |

*Primary Examiner*—John E. Murtagh
*Attorney, Agent, or Firm*—Willard J. Hodges, Jr.

[57] ABSTRACT

A building constructed of "C" channel frame components having an overlapping, interlocking sheet metal exterior secured to and enclosing the frame. Rigidity is imparted to the building by the mono-coque construction receiving and distributing wind and other lateral stresses to the skin frame combination. The procedural steps for constructing are exceedingly economical of personnel and man hour requirements. The completed building is portable to site of use.

8 Claims, 12 Drawing Figures

MONO-COQUE BUILDING STRUCTURE AND METHODS

BACKGROUND OF THE INVENTION

1. Field of the Invention

This invention pertains to a building having a frame enclosed in sheets of material. The completed structure absorbs tensional and torsional loads in the outer skin. Wind loads are absorbed in stresses in the outer skin. The combined frame skin structure provides a light, stable structure acceptable for a wide variety of uses. This invention pertains to a mono-coque building preferably constructed at a building locality and transported to site of use.

2. DESCRIPTION OF PRIOR ART

Mono-coque construction in airplanes and in racing and sophisticated sports cars is well known and widely used. A utilization of such techniques in building construction, to the best of the knowledge of your applicant, has not heretofore been known.

Sheet metal buildings such as the "quonset hut" are well known and widely used since the early 1940's.

A related frame structure would be U.S. Pat. No. 3,534,515, to Breed and a somewhat related use of skin components in U.S. Pat. No. 3,295,267 to Lundell.

SUMMARY OF THE INVENTION

The building of this invention differs from the prior art in that it is not a prefabricated building, pre-cut and assembled on the site. The structure is fully mono-coque in its embodiment and lends itself to construction at a central locality and transporting to the site of use. A final structure is movable at the locality of use due to light weight and strength of the mono-coque structure. The design of the components, the structure and the assembling methods result in a minimum requirement for personnel, material and man hours. In the preferred embodiment completed buildings have repeatedly been constructed by 2 men at a central building site in less than 8 hours.

One object was to devise a building structure economically in material and man hours.

Another object was light weight and strength enhancing portability at site of use.

A further object was to incorporate the attributes and advantages of mono-coque construction to a building.

A further object was to develop a method of construction exceedingly conservative in use of personnel.

The method of construction developed and utilized in constructing the preferred embodiment is exceedingly economical in man hours. The method of construction will be described in detail in relation to the description of the preferred embodiment.

DETAILED DESCRIPTION OF THE COMPONENTS OF THE PREFERRED EMBODIMENT AND METHOD OF CONSTRUCTION

Reference is made to the attached drawings wherein identical reference characters refer to identical or equivalent components throughout the various views and the detailed description of the preferred embodiment.

DESCRIPTION OF THE PREFERRED EMBODIMENT

Figure 1:
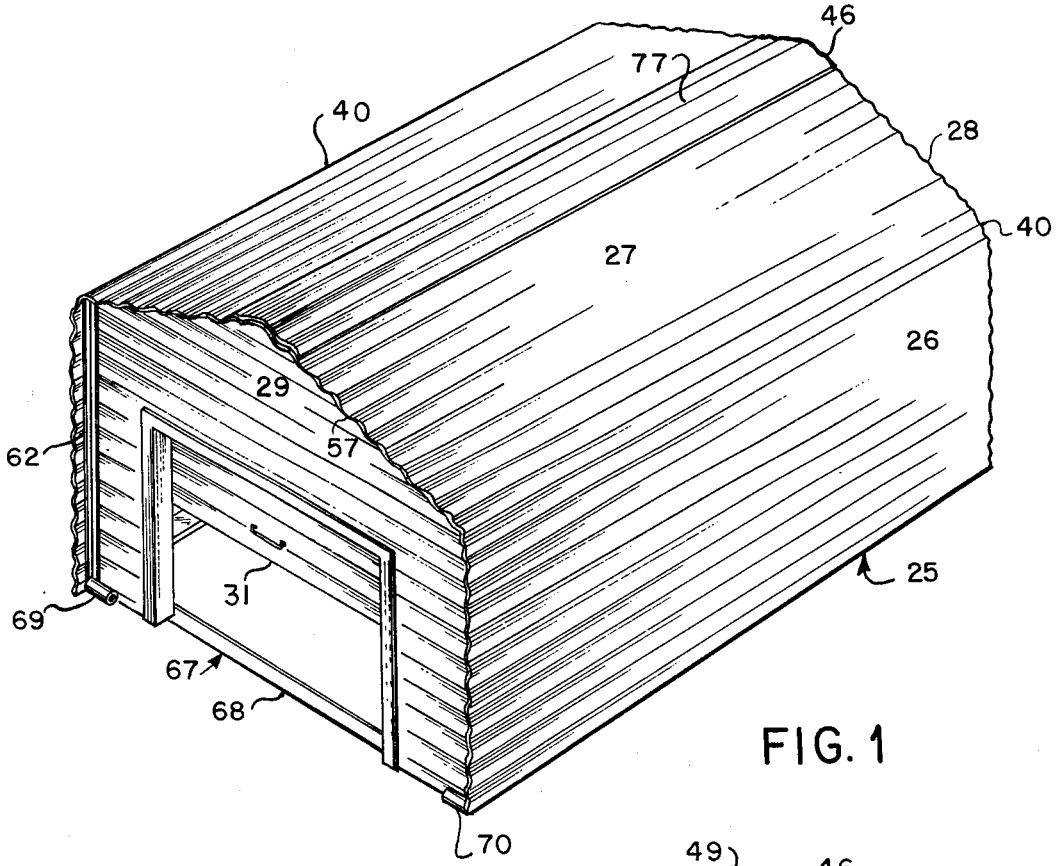
FIG. 1 is a view of the exterior of the completed building.
Figure 2:
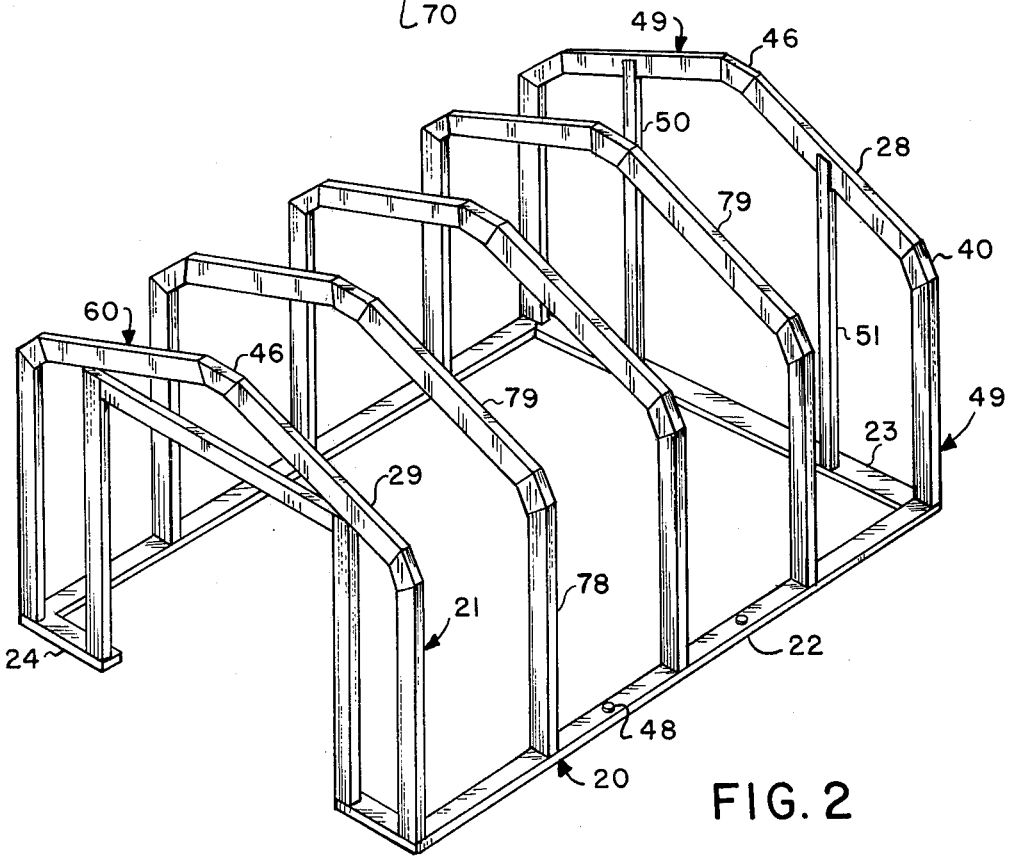
FIG. 2 is a composite view of the assembled frame structure.

The preferred embodiment was constructed from 4-inch C channel of mild cold rolled steel. The frame 20 of the building was formed by cutting and shaping the C channel components. The composite frame 20 comprises a series of arcuate ribs 21 secured to longitudinal stringers 22, the stringers 22 being secured by rear cross beam 23 and front cross beam 24. The frame 20 has secured to it an outer skin 25. This skin 25 is composed of side panels 26 and roof panels 27. The complete building generally includes an enclosed rear frame panel 28 and front frame panel 29. The front frame panel 29 might incorporate a variety of door components 30. The preferred embodiment, illustrated in FIG. 1, incorporates an overhead door 31.

Figure 3:
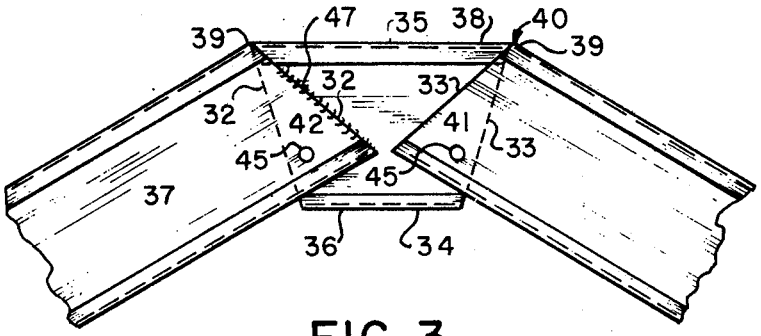
FIG. 3 is a detailed, fragmented view of an eave or peak joint in the "C" channel frame rib.

As to some of the details of the construction, composite frame 20 is constructed of the mild cold rolled C channel which is preferably galvanized pre-painted either by dipping or spray painting or use of paint gloves. The individual ribs 21 are formed in the C channel by making two diagonal cuts. The dimensions of the rib members 21 are determined by the size of the desired completed building. The eave and peak cut may be formed by making a first diagonal cut 32 at approximately a 60° angle in the C channel rib. The second diagonal cut 33 is also formed in the C channel rib flaring from the first diagonal cut 32. The cut results in approximately a 4-inch inner interconnecting segment 34 flaring out to a 7-inch outer interconnecting segment 35. This severs the inner rib of the C channel 36 and the connecting web 37. The outer rib 38 is left intact except for a short notched cut 39 at the edge to facilitate bending. After these cuts are formed the C channel may be placed on a jig and formed at the desired angle. The completed eave corner 40 is substantially as illustrated in FIG. 3. This bending, preferably in a jig, results in sidewall overlap 41 and a roof overlap 42. The eave corner 40 is secured by either welding the edges of the diagonal cuts 32 and 33 to the connecting rib 37 or sidewall overlaps 41 and 42 may be drilled forming a first and second securing hole and the components are attached with self-tapping screws 45. The carborundum metal cutting disc was used on an electric saw to make these diagonal cuts 32 and 33. Any of the wide variety of electric hand-held circular saws will function satisfactorily. The roof joint 45 can be formed in a manner just described; however, an alternative construction would be to cut the joint at a suitable mitre angle and weld the roof peak joint as illustrated at 47.

The foundation of the building might employ a wide variety of materials. The foundation is normally preconstructed of reinforced concrete or wood, and forms no specific part of this invention in that a completed mono-coque structure of this invention is completed and placed on the foundation. The members of the building contacting the foundation are stringers 22, rear cross beam 23, and the front cross beam 24. The multiple ribs 21 rest on stringers 22 and are attached by welding. The stringers are constructed of the same material as the ribs; that is, 4-inch C channel mild cold rolled steel, or other acceptable steel shapes may be substituted. The connecting rib 37 of the C channel may be drilled in the stringers 22 or the cross beams 23 and 24 and secured to the foundation by anchor bolts 48. Rear frame panel 28 is formed at one end of the building utilizing a rear rib 49. In the preferred embodiment this rear rib was reinforced by first rear vertical support 50 and a second rear vertical support 51. These supports rested on the rear cross beam 23 and were formed from 2-inch C channel resting on the rear cross beam 23 projecting upward and abutting against the first roof rafter 52 and the second roof rafter 53 of rear rib 49. These vertical supports 50 and 51 are welded to roof rafters 52 and 53 and also welded at the point of contact with rear cross beam 23.

Figure 4:
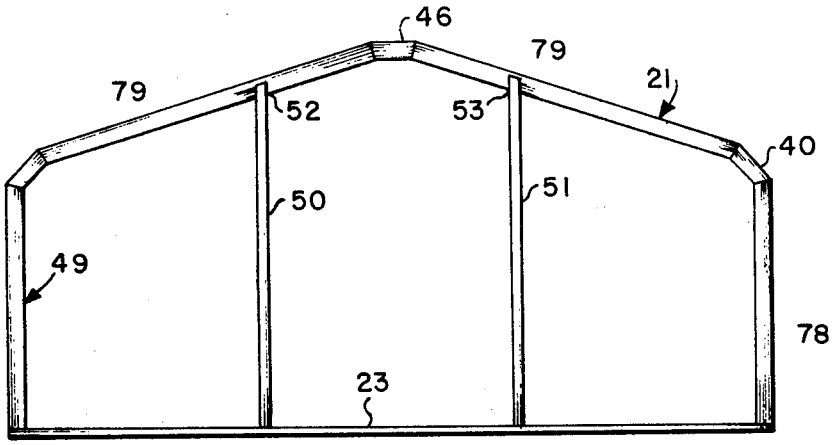
FIG. 4 is an inside view of the building presenting detail of the rear frame panel.
Figure 5:
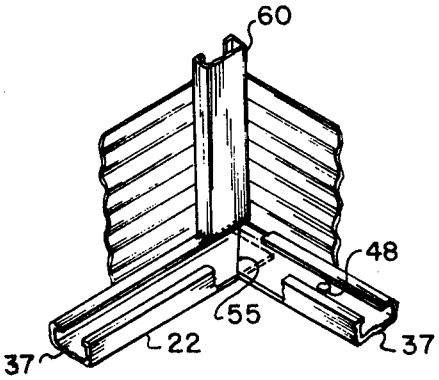
FIG. 5 is a fragmented view of the front inside corner portions of the C channel further fragmented to illustrate mitre angle of corner joint.

At the juncture of stringers 22 and rear cross beam 23 and front cross beam 24 a joint is made substantially as illustrated in FIG. 4. In the inner web 37 of stringers 22 are cut a 4-inch inner notch 54. This notch is to permit the rear cross beam 23 and front cross beam 24 to slide over and rest on the connecting web 37 of stringer 22. The cross beams are cut at a 45° mitre angle 55 and the cross beams 23 and 24 are placed in position and welded to the interconnecting web 37 of stringer 22. The 45° angle cut projects toward the corner of the building 56 to permit a weld entirely across the interconnecting web 37 of each member.

In assembly of the composite structure the individual ribs 21 are formed and secured by screw attachment 45 or welding 47 in the desired configuration. In the final assembly the stringers 22 and cross beams 23 and 24 are placed on a level ground support jig (not shown) on a completely level surface. The individual ribs 21 are then positioned at premeasured spots and welded at the point of contact of the ribs 21 and stringers 22. Some temporary securing means can be employed at the roof peak of the individual ribs to temporarily stabilize the frame structure 20. Upon completing the frame structure 20 the outer skin 25 is secured to the frame 20. In the preferred embodiment the outer skin was formed utilizing sheets of galvanized corrugated iron in sections projecting the length of the building with desired overhanging eave 57. The panels of the outer skin projecting the length of the building comprise the side panels 26 and roof panels 27. Side panels 26 are placed on the building with the uppermost panel overlapping the lowermost panel. The side panels 26 were secured to the leg segments 78 of the individual ribs employing TEK screws 58 which are self-drilling and self-tapping; that is, it will drill through the side panel 26 and the contacting rib 21 and taps ribs 21 and securely affixes the side panel 26 to the leg segment 78. The roof panels 27 are of identical material and comprise the roof section of the completed building. In attaching the roof panels 27 to the rafter segments 79 of ribs 21 TEK screws 58, including a neoprene rubber gasket 59, are employed. These screws may be placed in the building utilizing an electric drill to which is attached a socket fitting the head of the TEK screws 58 and 59. The rear frame panels 28 and the front frame panels 29 are secured to the rear rib 49 and the front rib 60 utilizing TEK screws 58 as just described.

Figure 6:
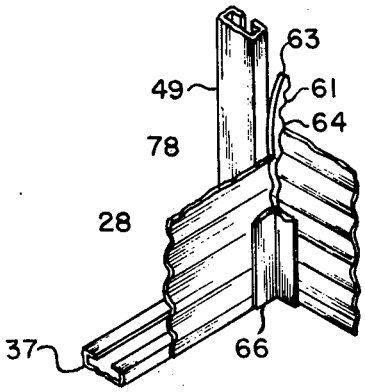
FIG. 6 is a fragmented view of the detailed construction of the corner of the building incorporating a corrugated rubber gasket as a corner seal.
Figure 7:
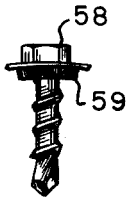
FIG. 7 is a detailed view of a self-drilling and tapping TEK screw with gasket.
Figure 8:
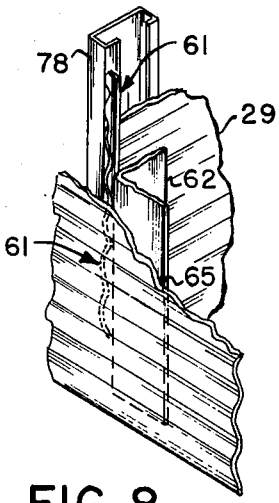
FIG. 8 is a fragmented view of the outside trim in position over the corrugated rubber gasket.
Figure 9:
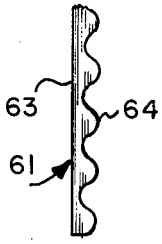
FIG. 9 is a fragmented view of a section of corrugated rubber gasket.
Figure 10:
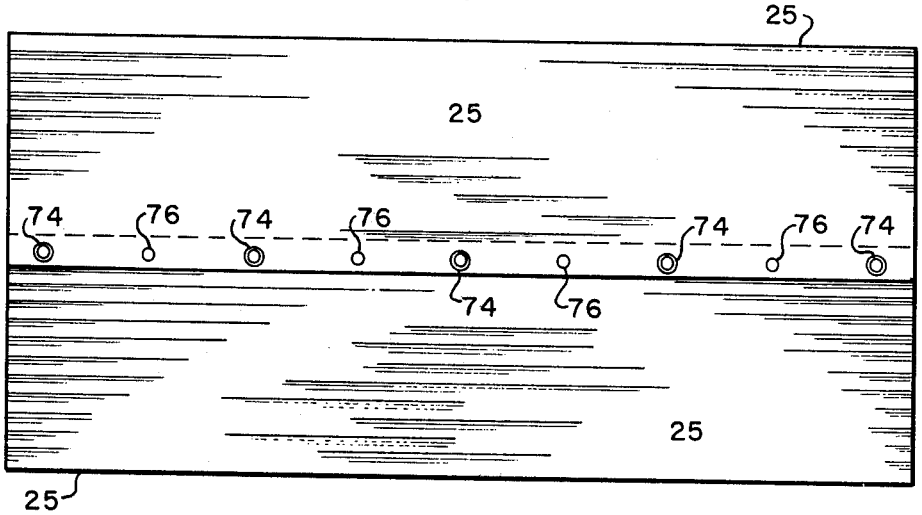
FIG. 10 is a plan view of the pre-drilled outside corrugated panels forming the skin of the building in the illustration two (2) panels are secured together.
Figure 11:
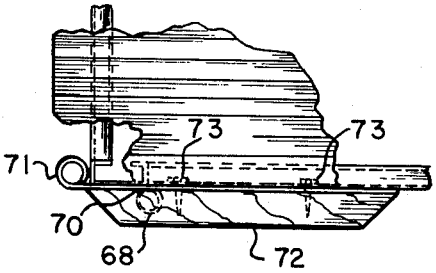
FIG. 11 is a fragmented view of a side corner of the building illustrating a corner skid pad and a type of eye bolt.
Figure 12:
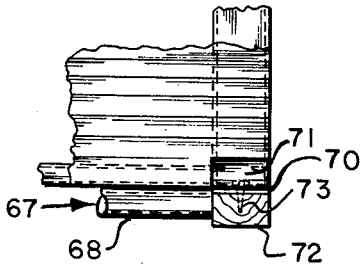
FIG. 12 is a fragmented view of a front corner of the building illustrating the skid pad and door beam attached.

One of the details of construction of the preferred embodiment includes the corrugated rubber gaskets 61 illustrated in FIGS. 6 and 9, and the outside trim 65 and 66 illustrated in FIGS. 6 and 8. The corrugated rubber gasket 61 is formed with a flat side 63 and a corrugated side 64. This gasket is employed at the front and rear edges of the building. The flat side 63 of the corrugated rubber gasket 61 is placed against corrugated edges of the rear frame panel 28 and the front frame panel 29 which conform exactly to the configuration of rear rib 49 and front rib 60. This dimension in configuration permits the placing of the corrugated rubber gasket 61 in position after which the forward and rear edges of side panels 26 are secured to the leg segment 78, and roof panels 27 are snugly secured to rafter segments 79 of the rear rib 49 and front rib 60 gripping the corrugated rubber gasket between the ribs 21 and the outer panels 26 and 27. This secures the edge joint substantially excluding wind or water. After this step of construction to enhance the outer appearance of the building the front outside trim 65, as illustrated in FIG. 8, and the rear outside trim 66, as illustrated in FIG. 6, are secured at the edges of the building. The foregoing components substantially comprise the completed building; however, ancillary features of this building are its portability and limited mobility at site of use. The light weight and strength of this mono-coque construction lends itself to the construction of the building at a central building site and portability to the point of use. To enhance its portability and skiddability at the site of use, an ancillary structure may be employed in conjunction with the building. For a description of this structure attention is invited to FIG. 11 and FIG. 12. The weakest point in the building of the configuration of this invention would be in the open or enlarged opening at the front or entryway of the building. If the building incorporated at one end an overhead garage-type door 31 to insure portability to the site of use and for skiddability at the point of use, a door beam 67 should preferably be incorporated. This door beam 67 comprises a longitudinal brace 68 and a first stringer pad 69 and a second stringer pad 70 which are bolted to the stringers 22 at each side of the building adjacent the door components 30. With door brace 68 securely in place the building may be positioned on a flat bed truck or trailer for hauling to the site of use. To facilitate limited mobility or skiddability of the building at the site of use eye bolts 71 may be secured at the corner of the building at the juncture of ribs 21 and stringers 22. These eye bolts 71 at the corners of the building are attachment points for a tow vehicle to skid the building into position. As an adjunct to the eye bolts 71 corner skid pads 72 may be secured to the ground side of stringers 22. These pads 72 are secured to stringers 22 by means of skid pad securing bolts 73.

METHOD OF CONSTRUCTION

The production of a typical garage-type skidder building of the preferred embodiment essentially follows the following procedural steps:

The first step is the painting of the frame material; the cold rolled C mild steel channel iron. This is accomplished by dipping in a paint vat, spraying or by use of a paint glove or combination of these. After the paint is completely dry the cutting process begins. Individual frame ribs 21 are placed in the cutting jig where angle diagonal cuts 32 and 33 are made with a portable saw equipped with a carborundum cut-off wheel. These diagonal cuts 32 and 33 are such that the C channel ribs 21 can be bent in a cross sectional manner to form the angle of the eave corner 40 or the roof peak joint 46 of the building. The ribs 21 may be formed ½ of a rib 21 at a time, bent, and stacked. The complete rib 21 may be later formed when two halves are placed in a jig and welded 47 at their juncture, FIG. 3, or the bend may be secured by placement of self-tapping screws 45. Front frame panel 29 and the rear frame panel 28 are made also in special jigs by first positioning complete rib 21 in the jig and then placing special cut door jambs, sills and other members and welding them together in a conventional manner. Front and rear panels 28 and 29 are next covered with a corrugated metal outer skin 25 and secured with self-drilling and tapping TEK screws 58, then securing the outside trim 65 and 66. These panels may be stacked for later assembly into a complete building. The next step would consist of placing the longitudinal stringers 22 on a special plumbed and squared track precisely leveled in the desired configuration for the base of the building. Ribs 21 are welded in an upright position simulating the bows of a covered wagon. A temporary removable ridge pole or spacer may be attached to the ribs 21 at the peak 46 from the front panel 29 to the rear panel 28. The next step consists of covering the frame work 20 with overlapping sheets of corrugated metal running the length of the structure forming a part of the outer skin 25. All sheets, walls and roofs are parallel and placed in sequence. Sheet metal bins are positioned on each side of the production bay. In moving the sheets from the bins over the frame 20 of the building the edges of the sheets may be riveted employing pop rivets 76 and the metal sheets moved in a continuous structure from the bins over the frame 20 of the building. These sheets ride on a temporary cross piece spanner a distance from the bins to the eave corner 40. This series of sheets forming the outer skin 25 may be pulled into position by windlass or other device having an increased mechanical advantage. The sheets of the outer skin 25 are aligned with the ribs 21 with the prepositioned guide holes 74. The sheets are adjusted and attached to the framework or ribs 21 using self-drilling sheet metal TEK screws 58. In placing this sheet metal into position on the frame 20 it is preferable to work from one side of the building. Sheet metal skin 25 is taken out of bins on one side and pulled over cross pieces spanning the distance from the bins to the eave 40 of the building and pulled over the roof peak 46. Series of sheets forming the outer skin 25 are pulled past the roof peak joint 46 after which a sheet forming a ridge cap 77 is placed over the juncture of the sheets temporarily secured by vice grips and the cross pieces removed and the metal skin 25 pulled to a pre-determined point and then draped over the framework 20. Pre-drilled sheets 25 are then secured to the leg segments 78 of ribs 21. Pre-drilled guide holes 74 are first secured after which additional TEK screws 58 are applied to the side walls and TEK screws 58 with neoprene gaskets 59 employed in the roof panels 27 to the rafter segments 79. The next step of construction is sealing the edges with corrugated rubber gaskets 61 covering the corners with the thin galvanized metal angle trim 65 and 66 to present a finished appearance. The last step of the construction is to install an overhead door 31 and move the building to its permanent or temporary location.

This invention and the construction of the preferred embodiment have been described in detail together with a detailed description of the process or method for constructing the building. Changes in materials would be obvious to one skilled in the art. What is desired to be claimed is all modifications and embodiments of this invention not departing from the scope of the equivalence of the appended claims.

I claim:

1. A mono-coque building structure comprising:

A. an integral frame structure comprising:

1. a first base stringer projecting the length of said building,
2. a second base stringer projecting the length of said building,
3. a plurality of free-standing ribs uniformly projecting upward from said first and said second base stringers,
4. said free-standing ribs formed from C channel comprising:
   a. a first diagonal cut extending partially through said C channel,
   b. a second diagonal cut spaced from said first diagonal cut and projecting substantially through said C channel,
   c. the extension of said C channel from said first diagonal cut comprising a leg segment,
   d. the extension of said C channel from said second diagonal cut comprising a rafter segment,
   e. an interconnecting segment interconnecting said first diagonal cut and said second diagonal cut,
   f. a bend formed in said C channel further comprising,
   g. a first overlap formed by the overlapping said leg segment and said interconnecting segment,
   h. a second overlapping of said rafter segment and said interconnecting segment,
   i. a securing means for securely attaching said overlapping segments, B. an outer skin enclosing said frame structure, and C. securing means for firmly attaching said outer skin to said frame structure forming a mono-coque structure.

2. The invention of claim 1 wherein said securing means for the said overlapping segments comprises self-tapping screws.

3. The invention of claim 1 wherein said securing means for said overlapping segments comprises a weld.

4. The invention of claim 1 wherein said securing means for said overlapping segments comprises a combination of a self-tapping screw and a weld.

5. The invention of claim 1 wherein said securing means for said outer skin to said frame structure comprises self-drilling and self-tapping TEK screws.

6. The invention of claim 1 wherein said integral frame structure comprises:

A. a front cross beam interconnecting the base stringers at the front end of said building, B. a rear cross beam interconnecting said base stringers at the rear end of said building, said base stringers and said front and rear cross beams securely attached in an integral structure.

7. The invention of claim 1 comprising:

A. a front wall enclosing an end of said building,

B. a door projecting through said front wall of said building,

C. a door beam projecting the length of said door structure intermediate said first and said second base stringers, D. a first stringer pad firmly secured to said door beam contacting said first stringer, E. a second stringer pad firmly secured to said door beam contacting said second stringer, F. securing means for firmly attaching said first and second stringer pads to said first and said second stringers, G. multiplicity of corner skid pads secured to each corner of said building below said stringers, and H. eye bolts firmly secured to said frame structure adjacent said corner skids forming a suitable structure for attaching tension means for skidding said building.

8. A mono-coque building structure comprising:

A. an integral frame structure comprising:

1. a first base stringer projecting the length of said building, 2. a second base stringer projecting the length of said building, 3. a plurality of free-standing ribs uniformly projecting upward from said first and said second base stringers, 4. said free-standing ribs comprising:

a. a leg segment projecting upward from said base stringer, b. a bend including an overlapping segment, c. a securing means for securely attaching said overlapping segments, B. an outer skin enclosing said frame structure, C. securing means for firmly attaching said outer skin to said frame structure forming a mono-coque structure, said frame structure and outer skin comprising:

D. a rear frame panel securely attached to said base stringers,

E. a rear outer skin covering said rear frame panel,

F. a front frame panel securely attached to said base stringers,

G. a front skin covering said front frame panel,

H. said outer skin overlapping and enclosing said rear panel and said rear outer skin, I. said outer skin overlapping and enclosing said front frame panel and said front skin, J. a corrugated plastic gasket intermediate said outer skin and said rear skin forming substantially a water-tight structure, K. a corrugated plastic gasket intermediate said front skin and said outer skin sealing said juncture and forming substantially a water-tight structure, and L. metal trim positioned exterior of said corrugated plastic gasket covering the exterior of the juncture of said outer skin and said rear skin and said front skin and skin.

* * * * *